US009498015B2

(12) United States Patent
Kim

(10) Patent No.: US 9,498,015 B2
(45) Date of Patent: Nov. 22, 2016

(54) VISOR ADAPTED FOR HELMET OR HEAD ENGAGEMENT

(71) Applicant: Heivi Min Kim, Escondido, CA (US)

(72) Inventor: Heivi Min Kim, Escondido, CA (US)

( * ) Notice: Subject to any disclaimer, the term of this patent is extended or adjusted under 35 U.S.C. 154(b) by 0 days.

(21) Appl. No.: 14/988,423

(22) Filed: Jan. 5, 2016

(65) Prior Publication Data

US 2016/0128416 A1 May 12, 2016

Related U.S. Application Data

(63) Continuation-in-part of application No. 12/987,996, filed on Jan. 10, 2011, now Pat. No. 9,226,538.

(60) Provisional application No. 61/293,466, filed on Jan. 8, 2010.

(51) Int. Cl.
*A42B 3/22* (2006.01)

(52) U.S. Cl.
CPC ..... *A42B 3/227* (2013.01)

(58) Field of Classification Search
CPC ..... A42B 3/22; A42B 3/221; A42B 3/226; A42B 3/227
See application file for complete search history.

(56) References Cited

U.S. PATENT DOCUMENTS 642,440 A * 1/1900 Gerstle ..... A42B 1/247 2/10
1,175,167 A * 3/1916 Moscherrosch ..... A42B 1/248 2/10
1,266,503 A * 5/1918 Liederman ..... A42B 1/062 2/10
1,519,590 A * 12/1924 Mull ..... A42B 1/062 2/10
2,874,387 A * 2/1959 Bannister ..... A42B 1/062 2/10
4,292,689 A * 10/1981 Townsend, Jr. ..... A61F 9/045 2/12
4,896,375 A * 1/1990 Colucci ..... A42B 1/062 2/12
5,119,514 A * 6/1992 Woehl ..... A42B 1/068 2/172
5,406,645 A * 4/1995 Lin ..... A42B 1/24 2/10
5,487,191 A * 1/1996 Ridley ..... A42C 5/04 2/10
5,647,060 A * 7/1997 Lee ..... A41D 13/11 128/857
5,669,071 A * 9/1997 Vu ..... A42B 1/247 2/10
5,862,523 A * 1/1999 Proctor ..... A42B 1/064 2/171
5,996,125 A * 12/1999 Garzone ..... A42B 3/227 2/10

(Continued)

*Primary Examiner* — Danny Worrell
(74) *Attorney, Agent, or Firm* — Donn K. Harms

(57) ABSTRACT

A visor configured for engagement to a riding helmet for horseback riders in an as-used position. The visor has an extra long frontal bill which extends around the helmet to side portions. The bill protects the eyes and most of the rider's face from sun and the sides protect the ears and side of the face. An elastic band provides a biased engagement to a helmet and optional vent apertures and retainment clips are employable to hold the device to a helmet more securely in high wind.

8 Claims, 6 Drawing Sheets

(56) References Cited

U.S. PATENT DOCUMENTS

| | | | | |
|---|---|---|---|---|
| 6,341,380 | B1 * | 1/2002 | Coleman | A42B 1/02 2/171 |
| 6,546,559 | B1 * | 4/2003 | Bronson | A61F 9/025 2/10 |
| 7,082,618 | B1 * | 8/2006 | Muso | A42B 7/00 2/175.1 |
| 7,258,436 | B2 * | 8/2007 | Heil | A42B 1/247 2/10 |
| 7,398,560 | B1 * | 7/2008 | Swensen | A42C 5/04 2/182.2 |
| D657,501 | S * | 4/2012 | Arousa | D29/122 |
| 2004/0006807 | A1 * | 1/2004 | Wang | A42B 1/062 2/195.1 |
| 2004/0040067 | A1 * | 3/2004 | Pong | A42B 1/22 2/195.2 |
| 2004/0231033 | A1 * | 11/2004 | Cho | A42B 1/062 2/195.1 |
| 2007/0061937 | A1 * | 3/2007 | Curle | A42B 1/062 2/12 |
| 2008/0066216 | A1 * | 3/2008 | Yun | A42B 1/067 2/410 |
| 2009/0025113 | A1 * | 1/2009 | Kelleghan | A42B 1/24 2/12 |
| 2009/0049578 | A1 * | 2/2009 | Toyohiro | A41D 27/13 2/69 |
| 2009/0126076 | A1 * | 5/2009 | Ochoa | A42B 1/244 2/171.3 |

* cited by examiner

VISOR ADAPTED FOR HELMET OR HEAD ENGAGEMENT

This application is a Continuation-in-Part Application to U.S. patent application Ser. No. 12/987,996 filed on Jan. 10, 2011, which claims Priority to U.S. Provisional Application No. 61/293,466 filed Jan. 8, 2010, both of which are hereby incorporated herein in their entirety by reference.

FIELD OF THE INVENTION

The disclosed device relates to headwear for sun and glare protection for the eyes and head. More particularly, it relates to a visor adapted for engagement to a standard riding helmet for horseback riding or to the head of a user. The visor is adapted with a substantially transparent bill to provide riders with an overhead view of potential injurious branches and such encountered in an elevated position by a horse. The bill is formed of lightweight polycarbonate material and extends a distance sufficient to shade the entire face of the rider.

BACKGROUND OF THE INVENTION

Many outdoor sporting and hobby activities such as horseback riding, expose the rider to the full spectrum of sunlight when carried out during the daytime. Since riders and others outdoors are engaged in enjoyable activities, they tend to play and ride outdoors for extended periods of time. During this time the riders can therefore have their skin exposed to a considerable amount of sunlight which can cause sunburn and skin damage. Even with protective sunscreen lotion on their skin, such riders are still exposed for prolonged periods to light spectrums not blocked by sunscreen and to the UV light blocked by sunscreen which has deteriorated.

Such prolonged exposure to sunlight can cause skin aging, sunburn, and cellular damage, especially to the skin of the face, since the majority of the rest of the body may be covered by clothing. Such damage, in addition to an aged appearance, can also result in skin cancer. Consequently, a shading of the face is especially preferable, especially in sports like horseback riding.

The sport of horseback riding conventionally employs helmets for riders. However, for fashion, tradition, or other reasons, most riding helmets possess little or no bill projecting forward of the front of the helmet. The conventional bills are deficient to shade even the forehead of the user sufficiently and totally lack a distance of extension that will provide shade to the face of the user.

One reason for the lack of such an extending bill, is the fact that horseback riders, during a riding session, are mounted on horseback. Situated on a saddle or horse, with their torso extending even higher, positions the rider's head a considerable distance above the head of a human simply walking on the ground. Consequently, riders are in danger of striking low hanging branches, wires, and other hazards while moving on horseback, which are not encountered by walkers. For this reason, and for tradition and fashion purposes, the riding helmet bill lacks extension from the helmet, lest it block the user's view overhead which allows them to duck or otherwise avoid hazards.

Visors adapted to fit the head of users exist, however conventional such visors lack sufficient extension forward of the user's face, to shade the entire face from the overhead sun. Further, such visors are generally formed from canvas or cotton material and stiffeners which can make them heavy during long periods of wear. Still further, such visor bills are solid and impair the overhead view of the user and are thus not advisable for use in horseback riding, lest the rider fail to see an overhead hazard and become injured during a ride.

Additionally, such visors are highly prone to dismounting from their engagement to the rider's helmet due to frictionally engaging systems for the visor which easily dismount during riding of a horse. Such separations of the visor from the helmet are caused by the wind which is enhanced by the speed of the rider. Further, in wind during slow or fast riding, the mounted rider moves forward and concurrently up and down along the motion of the horse. The force of wind and of the vertical translation of the head in the wind makes the mounting of the visor a genuine problem since if the visor dismounts, the rider must also dismount to pick it up.

As such, there exists an unmet need for a visor which may be temporarily engaged to a riding helmet so that it may be removed for competitions and the like to maintain a conventional and traditional appearance. Such a visor should have a bill with an extension forward of the user's face sufficient to shade the entire face during the daytime and late afternoon. Such a visor with such an elongated bill should also provide the user with a view overhead during use, thereby allowing the user to duck or take evasive action from hazards overhead while elevated on a horse.

Still further, such a visor device, while adapted to engage on a helmet, should have sufficient inward bias to maintain a grip on the helmet during high speed riding of the horse. However, the band gripping the helmet, should also be of a material that is soft and will slide easily over the forehead of the user should the visor be mounted to their head without the helmet.

Finally, in addition to a biased inward mount to the exterior of the riding helmet, a visor device should also provide means for an easy engagement of the visor to the helmet which enhances resistance to dismount from wind force, as well as the rider horizontal and vertical movements while riding. Such a visor with an easily engaged and released means to maintain it in its mount on the riding helmet during all types of rider movement, would encourage use by riders.

In this respect, before explaining at least one embodiment of the helmet and head engageable visor with extended bill herein in detail, it is to be understood that the invention is not limited in its application to the details of construction and to the arrangement of the components set forth in the following description or illustrated in the drawings nor the steps outlined in the specification. The disclosed visor for head or helmet engagement providing overhead viewing through the bill, is capable of other embodiments and of being practiced and carried out in various ways as those skilled in the art will readily ascertain once educated in the novel device and method of this application.

Also, it is to be understood that the phraseology and terminology employed herein are for the purpose of description and should not be regarded as limiting in any manner. As such, those skilled in the art will appreciate that the conception upon which this disclosure is based may readily be utilized as a basis for designing other methods and systems for carrying out the several purposes of the engageable head visor device with extended bill as disclosed herein. It is important, therefore, that the claims be regarded as including such equivalent construction insofar as they do not depart from the spirit and scope of the present invention.

OBJECTS OF THE INVENTION

An object of this invention is the provision of a visor that may be engaged on both a helmet of a horseback or vehicle rider as well as comfortably on a human head.

An additional object of this invention is the provision of such visor which has an extended projection from front of the user's forehead or helmet where it is sufficient to shade the entire face of the user.

Yet another object is the provision of such a visor with such an extended bill, which also allows the user a view overhead and in front of their face to allow them to avoid overhead hazards.

Yet an additional object of the invention, is the provision of such a visor, with a frictional encircled engagement of the helmet which is enhanced by a biasing from an elastic tether to resist dismounts from wind and rider forward and vertical movements during riding.

These together with other objects and advantages of the disclosed visor device will become subsequently apparent to those skilled in the art, reside in the details of the construction and method herein as more fully hereinafter described and claimed, reference being had to the accompanying drawings forming a part thereof, wherein like numerals refer to like parts throughout.

SUMMARY OF THE INVENTION

The disclosed device herein addresses the foregoing shortcomings of the prior art in head visors. The disclosed device provides a visor adapted to engage with a helmet of a horseback rider in a biased frictional engagement to avoid dislodgement. Additional securement is provided by an elastic tether configured for an easy engagement between the bill of a riding helmet and the front of the visor where wind imparts the most dismounting force. Additionally, in the event of dislodgement during a high speed ride, a secondary tether is employable to secure the helmet band and bill to the user. This is particularly preferred to prevent the need for a horseback rider to dismount to retrieve the visor should wind or riding dismount it.

The visor includes an extended bill which engages the band at a first end and extends a distance much longer than conventional visors. This extended distance provides a means to shade the entire face of the user, even during the afternoon.

In spite of the extended distance, making the bill larger, it is formed of thin substrate of substantially transparent material such as polycarbonate. The transparency of the material provides the user a means to see through the extended bill for hazards. The thin material is also extremely lightweight and even with the over-extension, compared to conventional bills, is lighter in weight.

Engagement to the user's head or a rider's helmet is accomplished with the provided encircling band which is in a fixed engagement to a first side of the bill. This first side of the bill is cut in an arched shape which when engaged to the band which is engaged around the helmet, provides a means to arch the shape of the bill when it is in its biased frictional engagement to the helmet or head of a user. The arch additionally is in a curve that extends the bill around the head of the user slightly past the forehead to thereby form a bill extending to the sides of the helmet or head during use. The thin polycarbonate or similar material blocks UV light from reaching the user's face and forms a curve or arched shape in front of the user's face which extends to the sides and over the ears through the mounting with the band. Once removed however, the bill is able to reassume a substantially planar shape for easy transport and flat storage.

In use, the rider or user is fully protected from direct sunlight on their entire face and ears by the UV blockage provided by the polycarbonate bill extending forward and around the helmet or head. The light weight of the material helps avoid neck fatigue while affording a view overhead and in front of the user through the transparent material forming the bill.

An elastic tether may be provided to provide a biased engagement between the bottom of the bill of the visor, and the top of the small bill extending from a riding helmet. This elastic tether employs a hooked means of engagement over the frontal edge of the helmet bill at one end, and a hooked or permanent engagement to the band of the visor at the other. A stretching of the elastic material of the tether, provides the biasing force between the visor bill and the helmet bill and also a downward bias of the visor bill to help resist dismounting caused by wind lift as well as the momentum of the rider's head during riding.

Finally, a strap or laniard is affixed to the rear portion of the band. A distal end of the strap has a clip or fastener adapted to engage the collar or clothing of the rider. This is a preferred feature in that the visor can dismount in heavy winds or high speed rides which normally would require the rider to turn around and dismount to pick up the visor. The strap however maintains the visor proximate to the user during such a dismount from the head or helmet.

The preceding and other features and advantages of this invention will become further apparent from the detailed discussion that follows. Such description is accompanied by a set of drawing figures. Numerals of the drawing figures, corresponding to those of the written description, point to the features of the invention with like numerals referring to like features throughout.

With respect to the above description then, it is to be realized that the optimum dimensional relationships for the parts of the invention, to include variations in size, materials, shape, form, function and manner of operation, manner of formation, assembly and use, are deemed readily apparent and obvious to one skilled in the art, and all equivalent relationships to those illustrated in the drawings and described in the specification are intended to be encompassed by the present invention. Therefore, the foregoing summary and following description are considered as illustrative only of the principles of the invention to form a lightweight visor with extended projection and concurrent overhead viewing to avoid hazards. Further, since numerous modifications and changes will readily occur to those skilled in the art, it is not desired to limit the invention to the exact construction and operation and steps of formation shown and described, and accordingly, all suitable modifications and equivalents may be resorted to, falling within the scope of the invention.

DETAILED DESCRIPTION OF THE INVENTION

Figure 1:
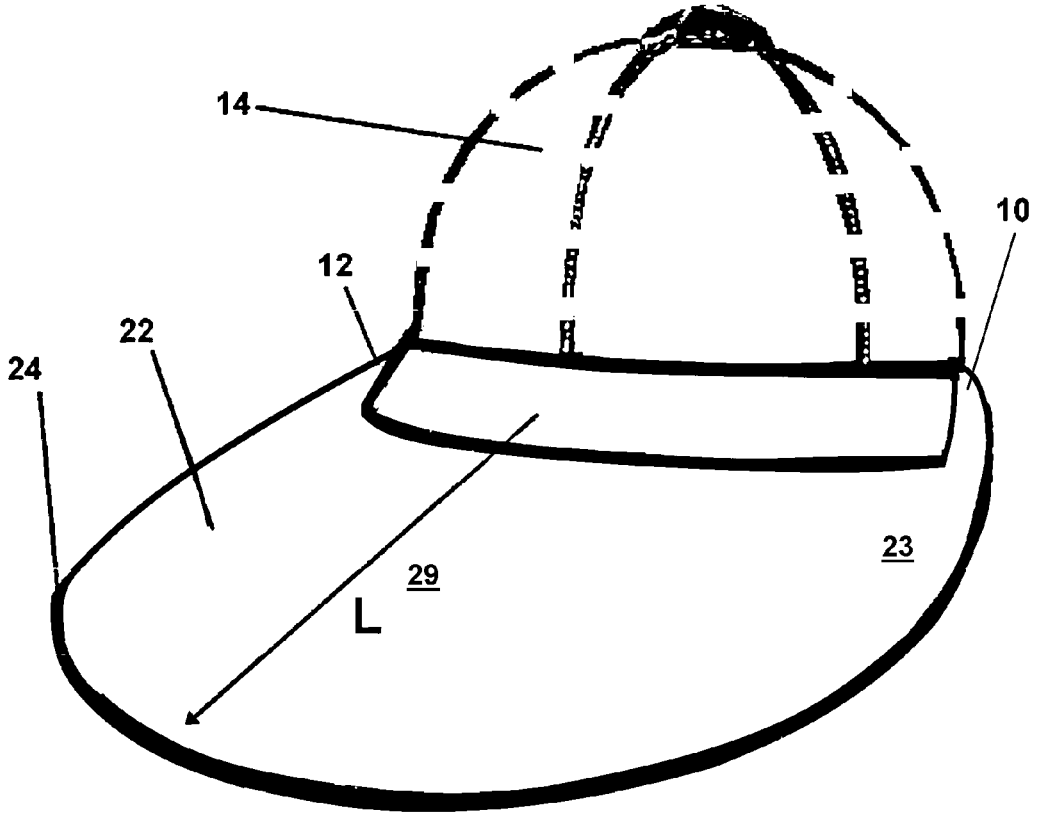
FIG. 1 is top plan view of the device showing it unmounted and the extra extension of the bill forward from the band.

Now referring to drawings in FIGS. 1-7, wherein similar components are identified by like reference numerals, there is seen in FIG. 1, the device 10 for engagement in combination with a conventional horseback riding helmet 14 which typically has a very short brim 11 (FIG. 4) which is at best insufficient to shade a rider's face and eyes during the day from over exposure to the sun. The device 10, as noted, provides an extended bill 22 which projects from the device 10, and the riding helmet 14 when attached, to significantly improve the protection to the rider from the sun while still affording the rider a means to view above their head when riding elevated on a horse through the substantially transparent material forming the bill 22.

Means for engagement to the helmet 14 is provided by a band 12 adapted for a stretched and biased engagement around a helmet 14 or the user's head. The two ends of the band 12 are engaged to hold the band elongated and biasing inward using fasteners 16 at the distal end of the band 12. The fasteners may be clips, hook and loop fabric, or other cooperatively engageable fastener halves and any such fastener as would occur to those skilled in the art are anticipated. The band 12 is, as noted, material having an elastic elongating nature preferably in order to exerted an inward bias to the circle of material formed by the engaged ends of the band 12. This inward bias provides a means to frictionally and compressibly engage around the circumference of a conventional rider's helmet 14 and to maintain the device 10 cooperatively engaged with the helmet 14 during riding to keep it from flying off during slow paced riding.

Preferably the inside surface 13 of the band 12 should be smooth and comfortable to fit a head or the helmet of a user as the biased engagement around the helmet 14 will hold it in place. The smooth surface 13 can be enhanced by coating or adding a layer of vinyl or smooth flexible plastic material on the inside surface 13 in areas where contact with the helmet 14 exterior are anticipated. Such conventionally worn helmets 14 are frequently covered with felt or other fabric which could be damaged by a rough or frictional fabric material over long periods of engagement. However, a smooth surface 13, when in a biased engagement, will both hold well to the helmet 14 and protect it from abrasion.

A safety strap 20 having an alligator clip 26 or similar gripping type fastener, to engage the user's clothing, or the helmet 14 may be provided to maintain the device 10 proximate to the user in case of dismount which could occur in high wind or when riding fast on a horse, which imparts a higher force on the device 10 than a walk or trot. Other modes of holding the device 10 to the helmet 14 are shown in subsequent figures.

Figure 2:
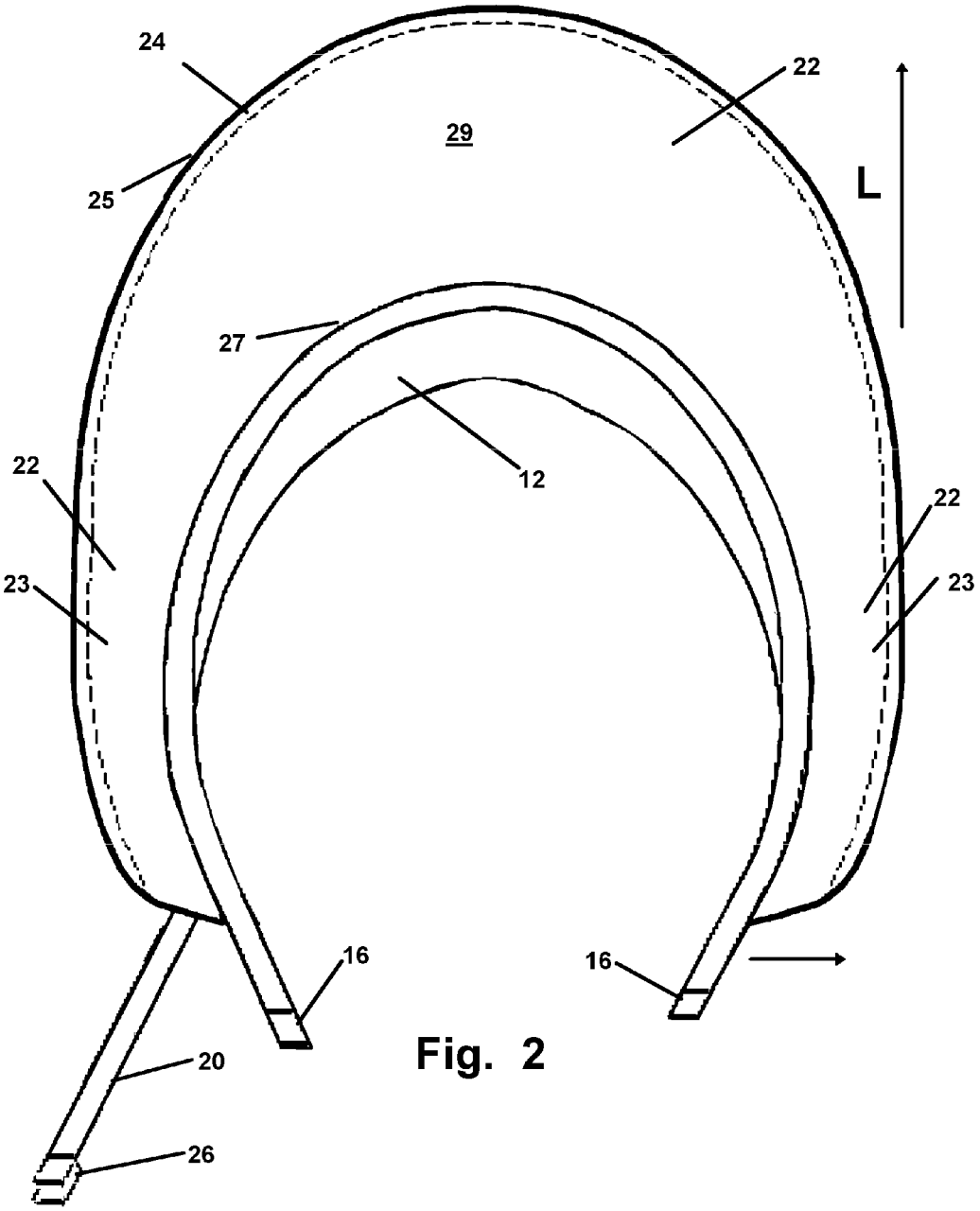
FIG. 2 shows a perspective view of the device in the as-used position, engaged upon a conventional riding helmet shown in dotted line, and having a frontal portion of the bill in an arch, projecting a distance "L" forward from the helmet.

Shown in FIG. 2, arched higher in the middle and descending to the lower side 23 portions, the bill 22 is formed of substantially transparent material which may be tinted, and extends a distance "L" forward from the band 12 and projects in front of the helmet brim 11, such that the entire face of the user is shaded. This is most desirable to riders who are outdoors riding frequently. An edging 24 is engaged upon the perimeter of the bill 22 as a means to protect the edge and surrounds the exterior perimeter arch 25 of the bill 22. The interior arch 27 of the bill 22 attached to or adjacent to the band 12, is cut in a steeper arch angle than the exterior arch 25, such that a biasing of the band 12 around a head or helmet 14, will cause a horizontal curve or arch in the bill 22 when extending from the helmet 14. Consequently, while the bill 22 lies substantially planar when not engaged to the helmet 14, once in a biased engagement thereon, the bill 22 arches causing the sides 23 of the bill 22 to curve downward with the edging 24 defining the distal edge of the bill 22 assuming a position lower than the inside edge running along the interior arch 27. The frontal portion 29 of the bill 22, arches such that the arch of the bill 22 in the middle area of the frontal portion 29 is highest, and it descends to the sides 23.

This arching of the bill 22 caused by the biased engagement of the band 12 to the helmet 14 perimeter, provides a means to lower the sides 23 of the bill 22 to better protect the ears and sides of the user's face, while raising the middle portion of the frontal portion 29 to give the user's eyes a better view forward than if the bill 22 were not arched upward. When riding elevated upon a horse, it is most important to see clearly, while also protecting the rider from harm from UV and sunlight.

While affording the rider excellent protection from overhead sun, the transparent nature of the bill 22 provides the user a means to see and ascertain overhead hazards such as poles or tree limbs when wearing the device 10 while riding. The material forming the bill is UV blocking material such as polycarbonate material which is also very light weight and somewhat rigid when pulled by the biased band to which it is engaged. As noted, the biased engagement to the helmet 14 and the resulting arch of the frontal portion 29, higher in the middle area and lower toward the sides 23, provides support to the frontal portion 29 from this arch, and allows for the elongated projection "L" of the bill 22 without having to add more support which would make it too heavy.

As noted, the bill 22 follows a circular path around the helmet 14 and provides an extension which curves lower on the sides 23 to cover over the ears as well as the sides of the face. The transparent fabric of the bill 22 may be tinted or otherwise colored to protect from glare or clear depending on user preference. It may also be polarized to provide superior glare protection.

Figure 3:
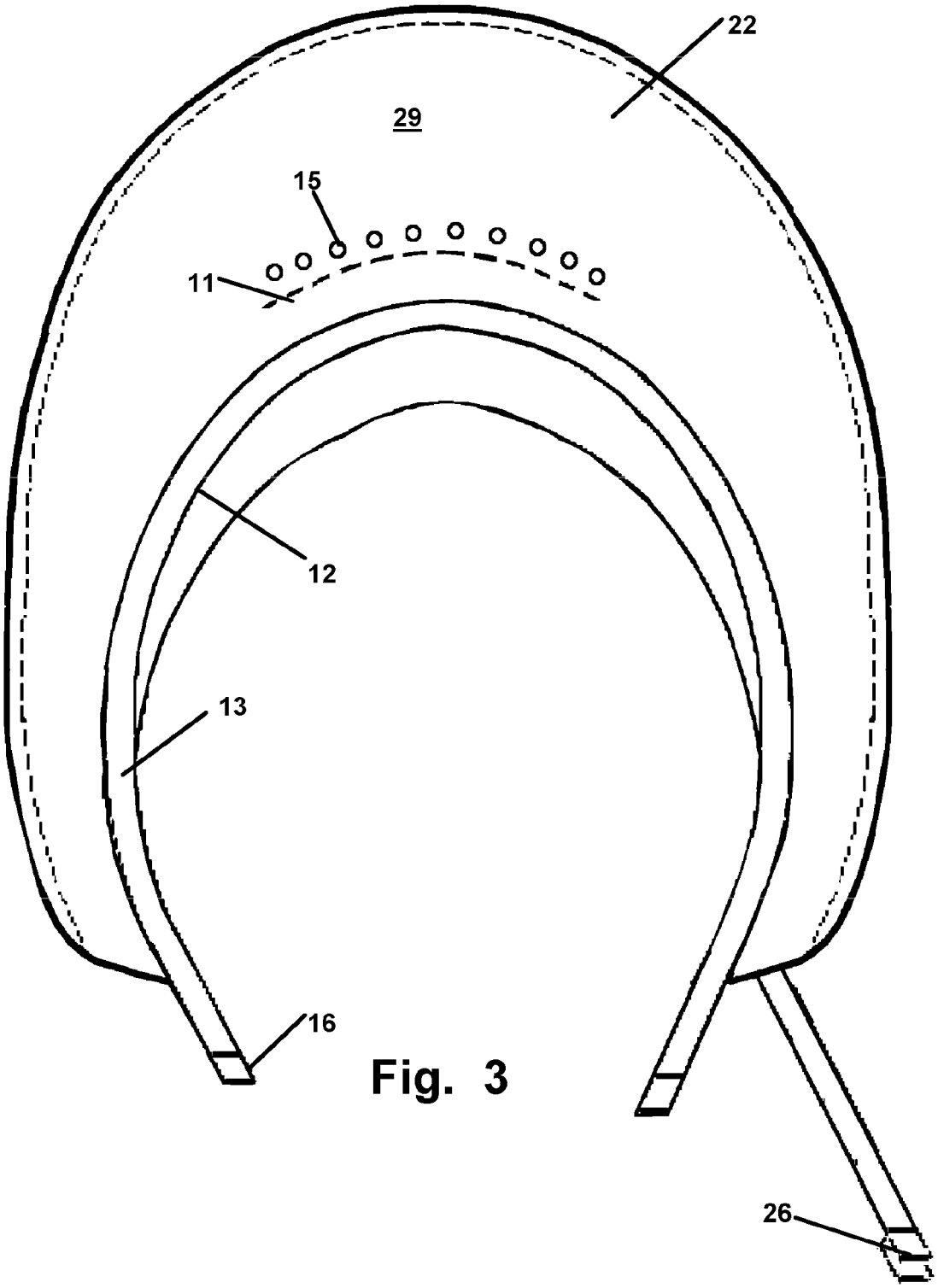
FIG. 3 depicts a bottom view of the device as in FIG. 1, and showing ventilation holes formed in the bill.

FIG. 3 depicts a bottom view of the device 10 as in FIG. 1, and showing optional ventilation apertures 15 communicating through the bill 22 in the frontal portion 29 and positioned to be just in front of the helmet brim 11 when the device 10 is engaged to the helmet 14 in an as-used position. The apertures 15 provide a means to ventilate the area under the bill 22 and just in front of the user's eyes when wearing the device 10 on their helmet 14. It also provides a relief for air building up under the bill 22 when riding fast from the wind in the user's face.

Figure 4:
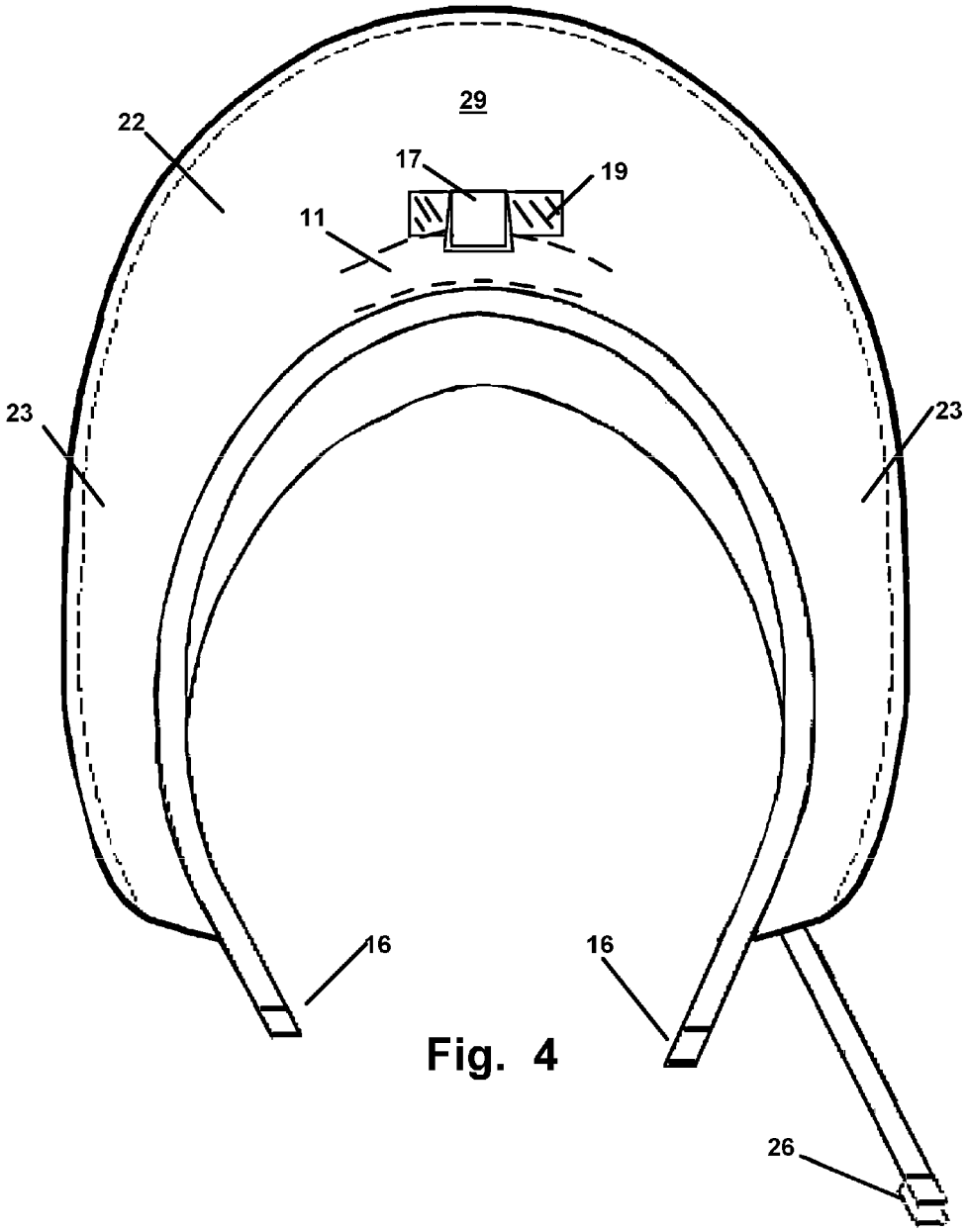
FIG. 4 depicts the device of FIG. 1 from a bottom view showing the optional but preferred clip for engagement to the conventional bill of a riding helmet shown in dotted line.

FIG. 4 depicts the device of FIG. 1 from a bottom view showing the optional but preferred clip 17. The clip 17 is positioned on the bottom surface of the frontal portion 29 of the bill 22 in a position such that it may be clipped upon the projecting brim 11 of a helmet 14. The clip 17 would be spring loaded or otherwise configured to engageable in a biased engagement with the brim 11. Optionally, because the helmet brims 11 can vary in size or projection, the clip 17 may be engaged upon piece of elastic material 19 which would be engaged to the bill 22. This allows the clip 17 a means for a floating mount to the device 10 or the bill 22, allowing it to be moved toward or away from the helmet 14 when engaging it to a helmet brim 11.

Figure 5:
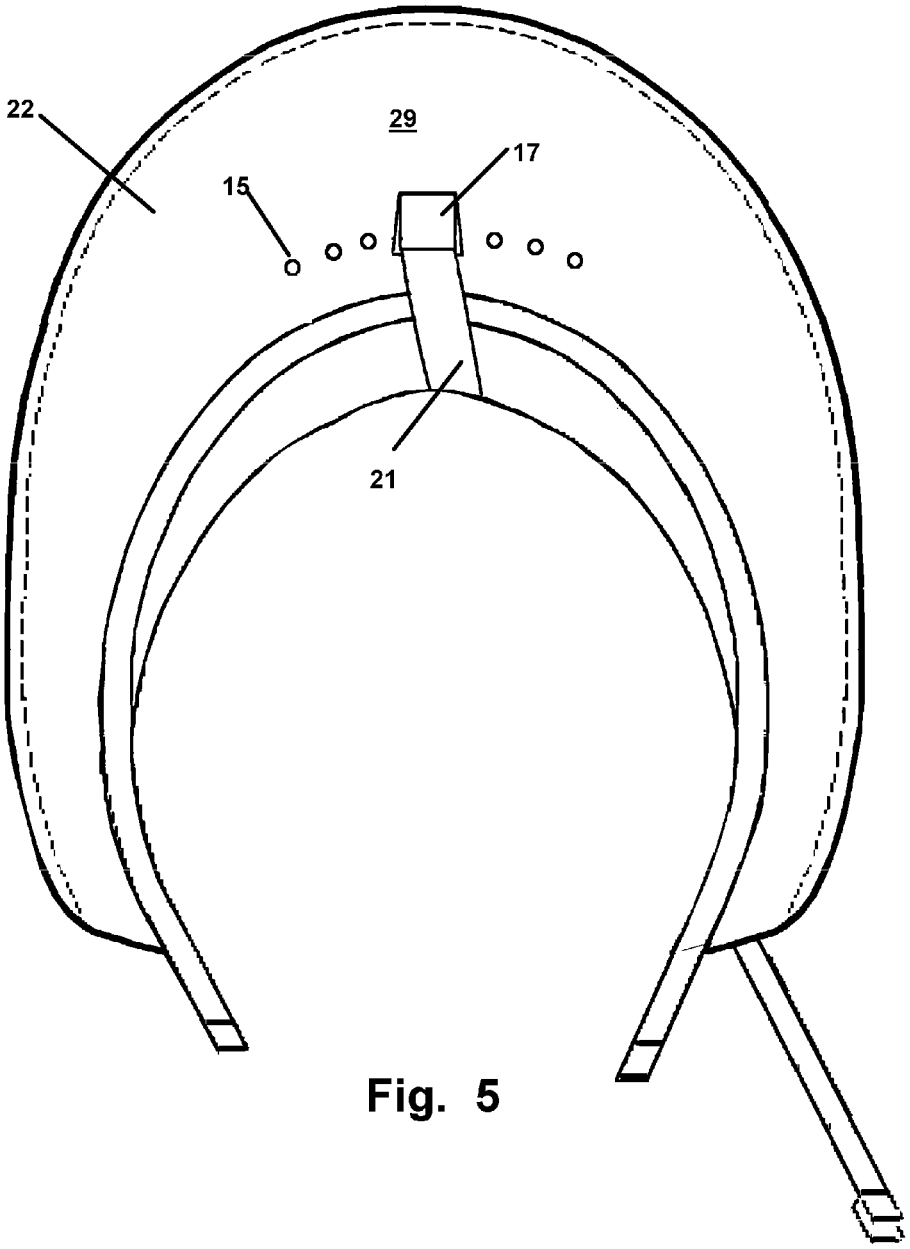
FIG. 5 depicts a bottom view of the device of FIG. 3 showing an elastic strap and at least one clip for engagement to the conventional bill of a riding helmet.

FIG. 5 depicts a bottom view of the device of FIG. 3 showing a strap 21 and clip 17 for engagement to the conventional brim 11 of a riding helmet 14. The strap 21 may be elastic material and is engaged to the clip 17 on a distal end and to the device 10 on the opposite end. The strap 21 allows the clip 17 to be engaged to the distal edge of the helmet bill 11 and provides a means for a floating mount of the clip 17 to the device 10 to accommodate any differing sized brims 11 which the user might encounter. In the device of FIGS. 4 and 5, the clip 17 provides a means to hold the bill 22 down under the pressure of wind which the user might encounter from weather or riding at higher speeds. By holding the bill 22 down and against the helmet brim 11 the device in the as-used position engaged to a helmet 14 is much more secure from a dismount.

Figure 6:
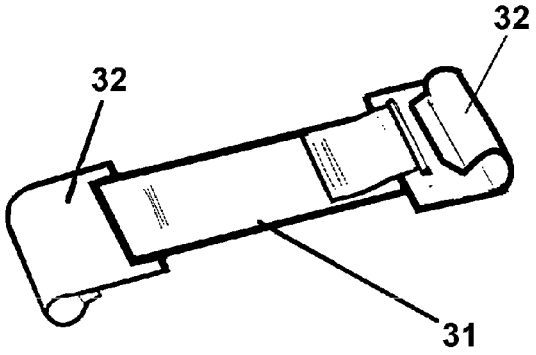
FIG. 6 shows a view of the elastic tether with opposing hooks configured for a biased engagement between the front of the riding helmet bill, and the frontal area of the visor herein.

FIG. 6 shows a view of the elastic tether with opposing hooks 32 engaged upon an elastic strap 31, to produce the biased engagement between the front of the riding helmet brim 11, and the frontal area of the visor device 10 herein. The elastic tether works best to maintain the close proximity of the device to or in contact with the bill 22 and to the helmet brim 11. When stretched the strap biases the two hooks 32 engaged to the helmet brim 11 and the central area of the device 10 toward each other which is especially helpful in wind or where the rider is moving both forward in the wind and vertically in a trotting of the horse.

Figure 7:
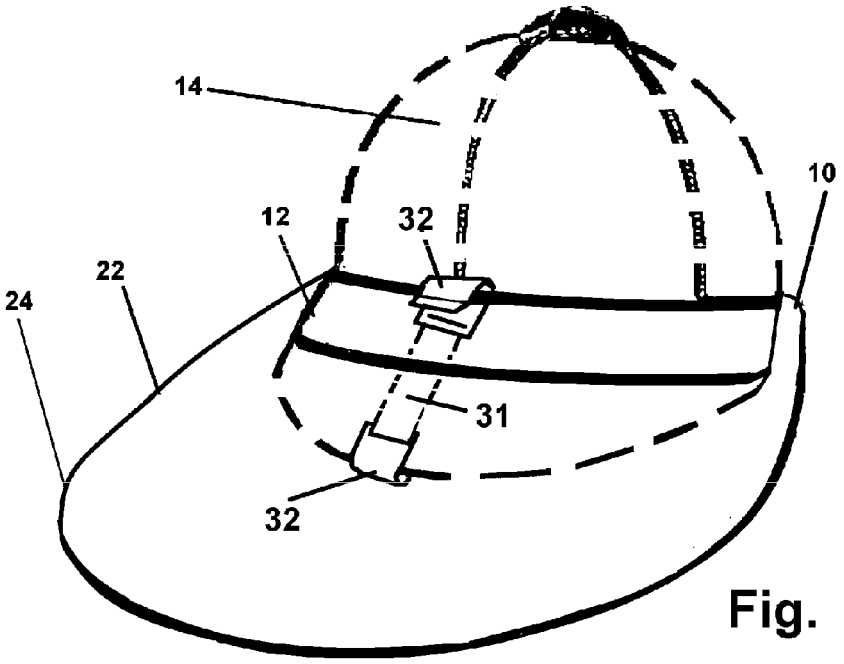
FIG. 7 depicts the device in a biased engagement upon a riding helmet with the two hooked ends removably engaged.

FIG. 7 depicts the device 10 using the elastic tether 30 to yield the biased engagement upon a riding helmet with the two hooks 32 on opposing distal ends removably engaged with both the helmet brim 11 and the device 10.

While all of the fundamental characteristics and features of the visor device adapted for head or helmet engagement and having an long projecting bill, been shown and described herein, with reference to particular embodiments thereof, a latitude of modification, various changes and substitutions are intended in the foregoing disclosure and it will be apparent that in some instances, some features of the invention may be employed without a corresponding use of other features without departing from the scope of the invention as set forth. It should also be understood that various substitutions, modifications, and variations may be made by those skilled in the art without departing from the spirit or scope of the invention. Consequently, all such modifications and variations and substitutions are included within the scope of the invention as defined by the following claims.

What is claimed is:

1. A visor configured for an engagement to a horseback riding helmet having a brim, said visor comprising:

an elongated band configured for an engagement to said riding helmet to hold said visor in an as-used position;

a substantially transparent bill extending a distance to an outside edge, from an inside edge connected to said band;

said bill having a frontal portion projecting away from said inside edge;

said bill extending along two side portions projecting to said outside edge from said inside edge located on opposite sides of said riding helmet;

said frontal portion positioned above and in front of the eyes of a rider wearing said helmet with said visor in said as-used position;

said side portions extending rearward of said frontal portion over the ears of said rider wearing said helmet with said visor in said as-used position;

a view provided through said frontal portion of said transparent bill providing said user riding on a horse, means to see overhead obstacles in front of said rider;

a view provided through said side portions of said transparent bill providing said user riding on a horse, means to see overhead obstacles on both sides of said rider;

said side portions forming shade upon said ears and the sides of said rider's face;

a clip said clip being removably engageable with said helmet to maintain said visor in said as-used position during said periods of increased wind;

said clip positionable to a floating engagement with said brim through a strap communicating between said clip and said visor, or an elongated strap communicating between said clip and one of said frontal portion of said bill or said band adjacent to said frontal portion of said bill.

2. A visor configured for an engagement to a horseback riding helmet having a brim, said visor comprising:

an elongated band configured for an engagement to said riding helmet to hold said visor in an as-used position;

a bill extending a distance to an outside edge, from an inside edge connected to said band;

said bill having a frontal portion projecting away from said inside edge;

said bill extending along two side portions projecting to said outside edge from said inside edge located on opposite sides of said riding helmet;

said frontal portion positioned above and in front of the eyes of a rider wearing said helmet with said visor in said as-used position;

said side portions extending rearward of said frontal portion over the ears of said rider wearing said helmet with said visor in said as-used position;

said side portions forming shade upon said ears and the sides of said rider's face; and a first clip positionable to a floating engagement with said brim, and a second clip engageable with said visor, and an elastic strap communicating between said first clip and said second clip.

3. The visor of claim 2 wherein said first clip and said second clip are S-shaped.

4. The visor of claim 3 additionally comprising:

said first clip and said second clip providing for respective floating engagement positions upon said band and said brim.

5. A visor configured for an engagement to a horseback riding helmet having a brim, said visor comprising:

an elongated band configured for an engagement to said riding helmet to hold said visor in an as-used position;

a substantially transparent bill extending a distance to an outside edge, from an inside edge connected to said band;

said bill having a frontal portion projecting away from said inside edge;

said bill extending along two side portions projecting to said outside edge from said inside edge located on opposite sides of said riding helmet;

said frontal portion positioned above and in front of the eyes of a rider wearing said helmet with said visor in said as-used position;

said side portions extending rearward of said frontal portion over the ears of said rider wearing said helmet with said visor in said as-used position;

a view provided through said frontal portion of said transparent bill providing said user riding on a horse, means to see overhead obstacles in front of said rider;

a view provided through said side portions of said transparent bill providing said user riding on a horse, means to see overhead obstacles on both sides of said rider;

said side portions forming shade upon said ears and the sides of said rider's face;

a fastener removably engageable with said helmet to maintain said visor in said as-used position during said periods of increased wind;

a strap engaged to said visor on a first end and to a removable engageable fastener at a second end; and said removably engageable fastener attachable to clothing worn by said rider to provide a means to maintain said visor adjacent to said rider should said visor become disengaged from said riding helmet.

6. The visor of claim 2 additionally comprising:

a strap engaged to said visor on a first end and to a removable engageable fastener at a second end; and said removably engageable fastener attachable to clothing worn by said rider to provide a means to maintain said visor adjacent to said rider should said visor become disengaged from said riding helmet.

7. The visor of claim 3 additionally comprising:

a strap engaged to said visor on a first end and to a removable engageable fastener at a second end; and said removably engageable fastener attachable to clothing worn by said rider to provide a means to maintain said visor adjacent to said rider should said visor become disengaged from said riding helmet.

8. The visor of claim 4 additionally comprising:

a strap engaged to said visor on a first end and to a removable engageable fastener at a second end; and said removably engageable fastener attachable to clothing worn by said rider to provide a means to maintain said visor adjacent to said rider should said visor become disengaged from said riding helmet.

* * * * *